United States Patent [19]

Vann

[11] 3,966,236

[45] June 29, 1976

[54] RELEASABLE COUPLING

[76] Inventor: Roy R. Vann, Box 38, Artesia, N. Mex. 88210

[22] Filed: Oct. 23, 1974

[21] Appl. No.: 517,391

[52] U.S. Cl. ..... 285/39; 285/315

[51] Int. Cl.[2] ..... F16L 37/22

[58] Field of Search ..... 285/315, 316, 277, 39; 166/297

[56] References Cited

UNITED STATES PATENTS

| | | | |
|---|---|---|---|
| 1,324,654 | 12/1919 | Ferguson | 285/316 X |
| 2,409,811 | 10/1946 | Taylor et al. | 285/315 X |
| 3,761,117 | 9/1973 | Shendure | 285/316 X |
| 3,827,258 | 8/1974 | Kammerer et al. | 285/315 X |

FOREIGN PATENTS OR APPLICATIONS

| | | | |
|---|---|---|---|
| 962,326 | 7/1964 | United Kingdom | 285/316 |

*Primary Examiner*—Thomas F. Callaghan
*Attorney, Agent, or Firm*—Marcus L. Bates

[57] ABSTRACT

A releasable coupling which can be interposed within a tubing string and the string subsequently parted by separating parts of the coupling from one another. A wire line fishing tool is used for actuating the releasing mechanism.

2 Claims, 9 Drawing Figures

RELEASABLE COUPLING

BACKGROUND OF THE INVENTION

In completing and producing oil wells, one can often foresee that a lower part of a tool string must subsequently be disconnected from the string and left downhole in the borehole. This is especially so in well completion work, wherein the lower tubing string is sometimes severed by use of clever explosive devices and dropped to the bottom of the hole. An important example of the desirability of separating a tool or pipe string is found in U.S. Pat. No. 3,706,344 to which reference is made for further background of this invention.

Accordingly, it is desirable to be able to separate a tool string at any predetermined location along its length. It is further desirable that the separation of the string be achieved while avoiding explosives because of the inherent dangers associated with the use of explosive devices, especially when used downhole in boreholes. Moreover, it is especially desirable that the separation of the string be effected by a wireline operation, and that it be brought about in an inexpensive and foolproof manner.

SUMMARY OF THE INVENTION

This invention relates to downhole tools, and specifically to a fluid conducting releasable coupling which can be interposed within a tool string for parting the string somewhere along its length by manipulation with a wireline fishing tool. An upper member telescopingly receives a lower member therein, with each member having means forming a plurality of radially spaced cavities within the overlaping marginal end portions thereof. A load transferring member is held into each cavity by a releasing member. The releasing member, upper member, lower member, and load transferring members are concentrically arranged relative to one another so that a fishing tool can engage and move the releasing member, thereby allowing the load transferring members to move from their respective cavities, whereupon the upper and lower members are then free to telescopingly move apart from one another.

Accordingly a primary purpose of this invention is the provision of a fluid conducting releasable coupling which ties together a tubing string in a releasable manner.

Another object of the invention is to provide a wireline actuated releasable coupling apparatus.

A further object of this invention is to provide a releasable coupling member having an internal member which is axially movable to cause one part of the coupling to be released from another part of the coupling.

A still further object of the invention is to provide a releasable coupling assembly having an unobstructed axial passageway formed therethrough.

The above objects of the invention are attained by the provision of telescoping members tied together by a load carrying member with the load carrying member being held in position by a releasing member, all of which are concentrically arranged respective to one another, in a manner whereby movement of the releasing member enables the telescoping members to be untied from one another.

DETAILED DESCRIPTION OF THE PREFERRED EMBODIMENT

Figure 1:
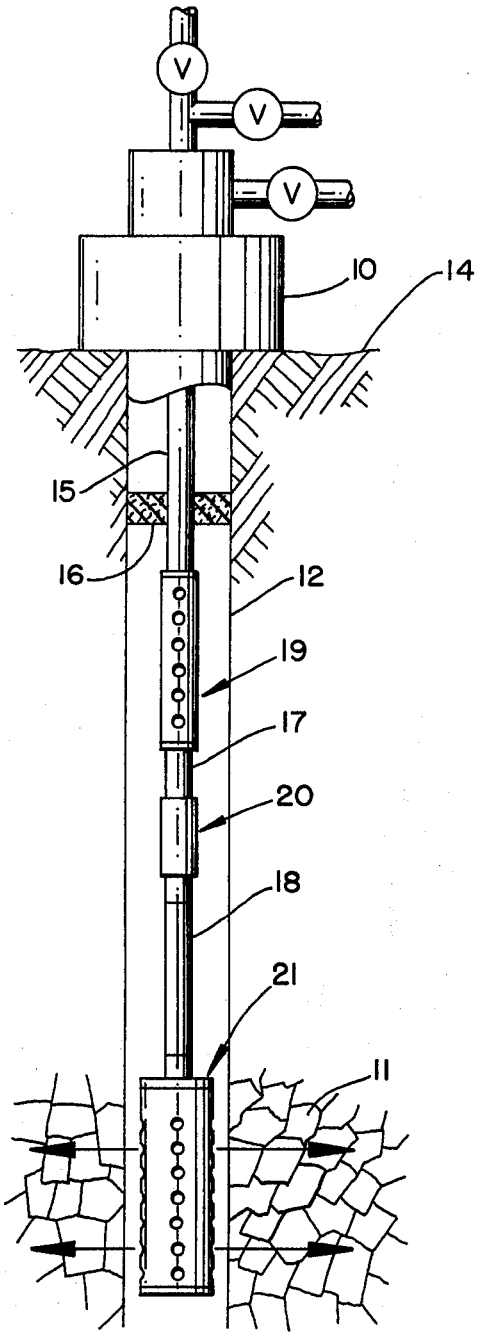
FIG. 1 is a part schematical, part diagrammatical representation of a borehole formed within the earth, with apparatus made in accordance with the present invention being disposed therewithin.
Figure 2:
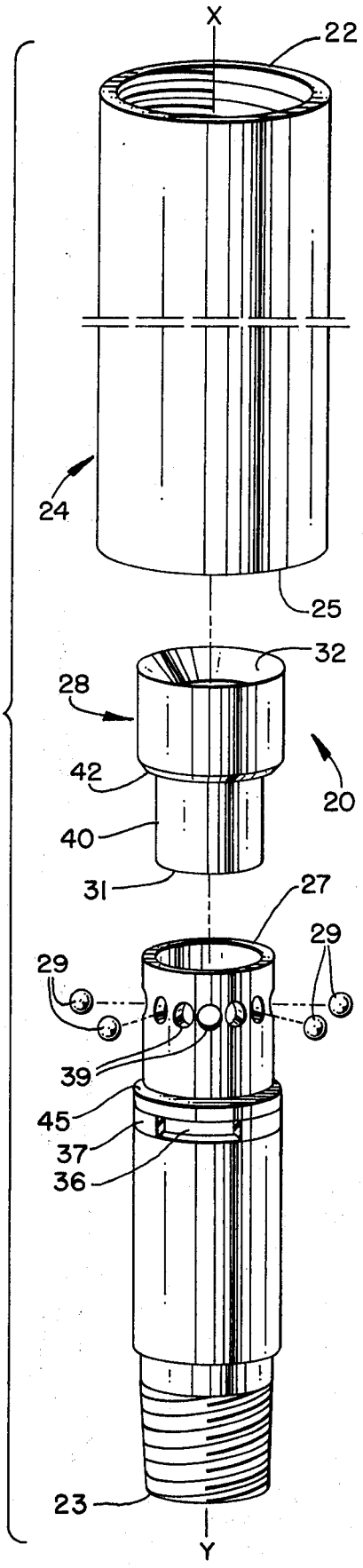
FIG. 2 is an enlarged, exploded, perspective view of part of the apparatus disclosed in FIG. 1.

In FIG. 1 there is disclosed a well head or christmas tree 10 in fluid communication with an oil producing strata 11 by means of borehole 12 which extends through the surface of the ground 14 so that production fluid flows uphole through production tubing 15.

Packer 16 separates the upper and lower borehole annulus and receives the production tubing therethrough. The production tubing continues at 17 and 18 in order to connect a vent string 19 to a releasable coupling 20 made in accordance with the present invention. Perforating gun 21 is connected to the releasable coupling and can be separated from the vent string at any subsequent time by manipulating the releasable coupling with a wireline actuated fishing tool of a type known to those skilled in the art.

Looking now to the details of the releasable coupling disclosed in the remaining figures, and especially the embodiment of FIGS. 2–7, it is seen that the coupling apparatus has an upper terminal end 22 spaced from a lower terminal end 23. The coupling is made of an upper cylindrical member 24 having a lower terminal end 25; a lower cylindrical member 26 having an upper terminal end 27; and an internal member 28, hereinafter referred to as a releasing element. The last named element can be moved to disengage the upper member from the lower member when the balls 29 are displaced from their seats as best seen diversly illustrated in FIGS. 2 and 6, and as will be more fully disclosed later on as this disclosure is more fully digested by those skilled in the art.

As seen in various other figures of the drawing, the tubing 15 is axially aligned with passageway 30 of the releasing element. The lower terminal end 31 of the releasing element is spaced from the inverted frusto cone 32 which forms the upper marginal end of the releasing element. The inside wall surface 33 of the upper member, inside wall surface 30 of the releasing member, and the inside wall surface 34 of the lower member form concentrically arranged chambers through which communication can be established between tubing lengths 15 and 18.

Radially spaced apart ball receiving chambers 35 are spaced from a seal chamber 36 within which there is disposed a resilient seal such as a Chevron ring 37.

The ball receiving chamber is formed by annulus 38 of the upper member which can be properly aligned with the radially spaced apart apertures 39 of the lower member, with the interior of the individual apertures being closed by the exterior wall surface 40 of the releasing member.

Figure 9:
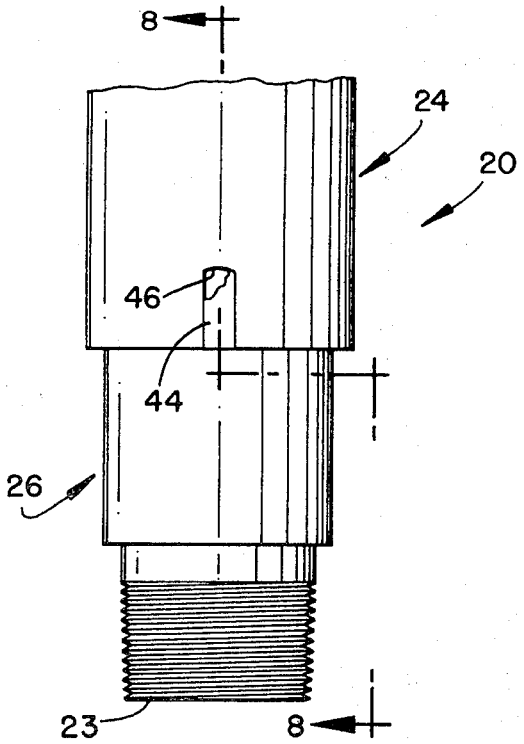
Figure 8:
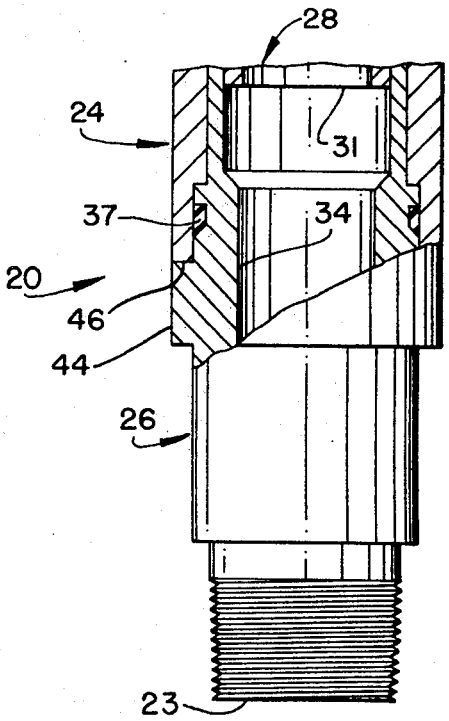
FIG. 8 is a fragmentary cross-sectional view taken along line 8—8 of FIG. 9; and, FIG. 9 is a fragmentary elevational view of a modification of the apparatus disclosed in FIG. 4.

In the modification set forth in FIGS. 8 and 9, a clutch, or splined connection 44 and 46 is incorporated into a marginal outer edge portion of the lower skirt portion of the upper member so as to render the upper and lower members non-rotatable respective to one another.

In operation, the box end of the releasable coupling is tied into the tubing with the pin end looking downhole and connected to whatever one might desire to subsequently release therefrom. When it is desired to separate the upper and lower members from one another, a wireline fishing tool is run downhole and through the releasing member 28, with the tool engaging shoulder 31 of the releasing member. The releasing member is easily lifted so that the radially spaced balls 29 are forced from cavity 35 and into passageway 30, thereby enabling the upper member to move relative to the lower member.

Where it is desired to run a dry tubing into the hole, the Chevron packing prevents fluid flow into the interior of the coupling.

Figure 3:
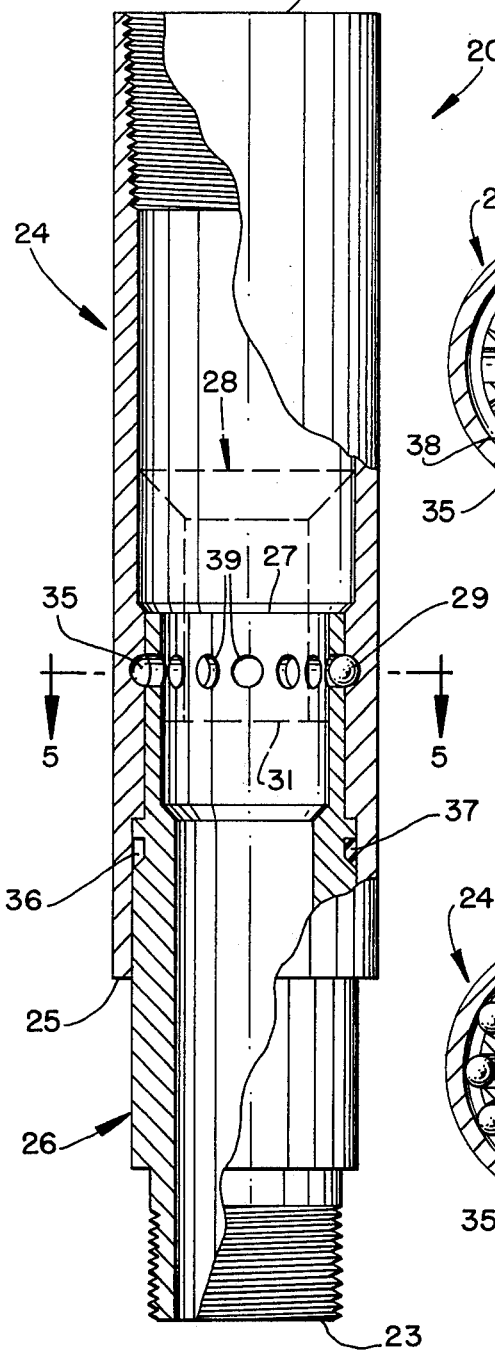
FIGS. 3 and 4 are enlarged, longitudinal, part cross-sectional representations of some of the apparatus disclosed in FIGS. 1 and 2, with some parts being removed therefrom.
Figure 5:
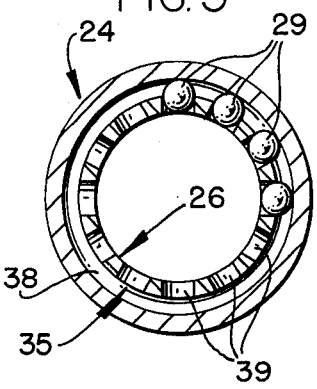
FIGS. 5 and 6, respectively, are cross-sectional views taken along lines 5—5 of FIG. 3 and 6—6 of FIG. 4, respectively.
Figure 6:
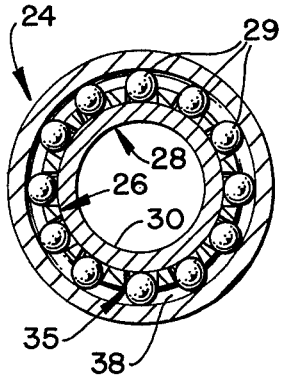
Figure 4:
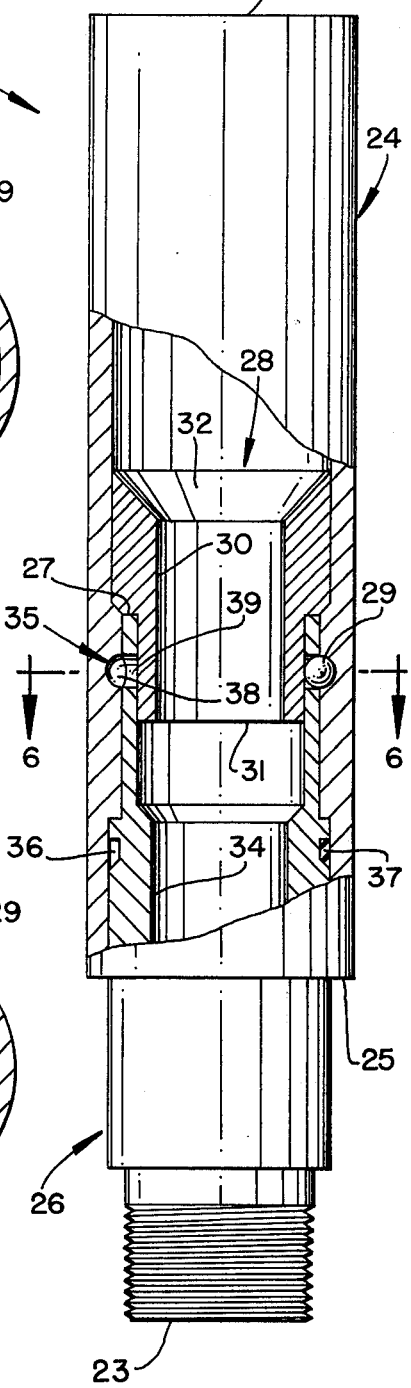
Figure 7:
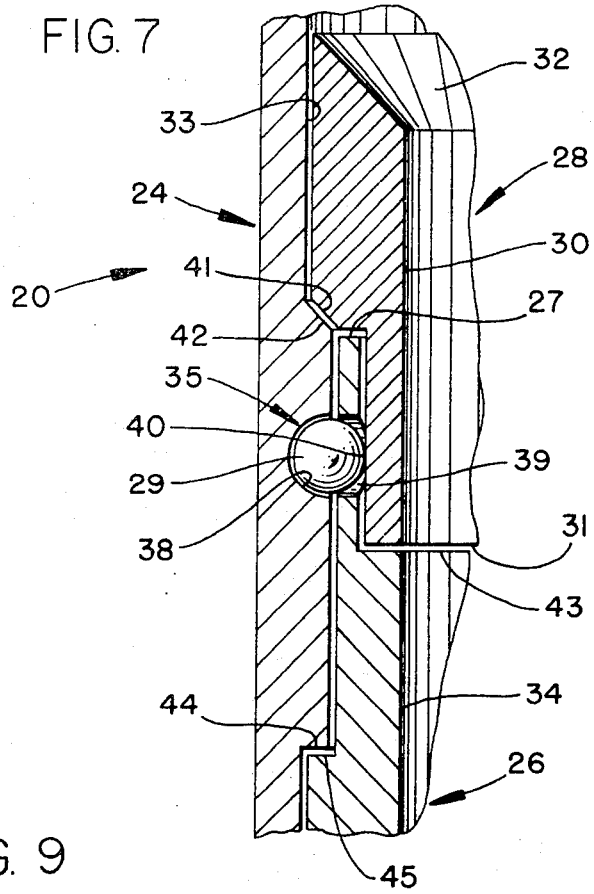
FIG. 7 is an enlarged, fragmentary, cross-sectional view of a detail of part of the apparatus disclosed in the foregoing figures.

The apparatus is assembled by applying grease to the apertures 39 so that the individual balls may be held properly positioned within the individual apertures while the upper and lower members are carefully telescoped together and into the illustrated position of FIG. 3. The releasing member is placed into the illustrated position of FIG. 4, thereby capturing the balls within their individual cavities, as best seen illustrated in FIG. 6, thereby completing assembly of the tool.

The tool can now be interposed within a tubing string in the manner of FIG. 1, until it is desired to part the string by actuating the releasing member. The tool can be built to carry loads in excess of the breaking strength of the tubing string within which it is interposed. The individual balls rest against the curved side-wall of the annulus formed within the upper member, and against the upper wall surface of the aperture formed within the lower member, thereby developing a large bearing surface between the two members. The location of the balls within their respective cavities is such that the balls are urged radially inward with a slight force which is resisted by the outer peripheral wall surface of the releasing member. Accordingly, reciprocal movement of the releasing member allows the balls to be forced radially inwardly, thereby releasing the upper and lower members from one another.

Where orientation of the lower string is necessary, a splined connection is incorporated into the co-acting members at a location externally of the seal. This expedient enables the lower portion of the string to be rotated by rotational movement of the upper portion of the string.

The tool can be series connected between adjacent guns, a gun and a vent string, or any other tool string combination that one may desire to release from the lower end of a tubing.

I claim:

1. A wireline actuated releasable fluid coupling apparatus which can be interposed within a tool string and arranged so that a wireline fishing tool can be used to part one marginal length of the string from the other, comprising:

an upper member having an upper end for attachment into an upper marginal length of a tool string;

a lower member having a lower end for attachment into a lower marginal length of a tool string;

means by which a marginal lower end of said upper member and a marginal upper end of said lower member can be slidably and telescopingly joined together in abuting relation, one within the other; seal means formed between said upper and lower member for precluding fluid flow therebetween;

a releasing member; said upper member, said lower member, and said releasing member being concentrically arranged respective to one another, means forming an axial passageway through said upper member, said lower member, and said releasing member; said releasing member being slidably received within at least a portion of said marginal lower end and marginal upper end;

an annulus formed within the outermost of said upper and lower members, and a plurality of radially spaced apertures formed within a wall of the innermost of said upper and lower members;

said annulus and said radially spaced apertures jointly cooperate together to form a cavity; a marginal length of said releasing member being interposed between said cavity and said axial passageway;

said cavity being radially inwardly directed and jointly formed by a portion of the overlapping marginal ends of said upper and lower members;

a plurality of spherical objects of a diameter to be received within said cavity and to simultaneously bear against structure forming said annulus, said apertures, and said releasing member;

said releasing member having a wall surface thereof which bears against said spherical members to hold each said member within said cavity;

abutment means formed on a lower end portion of said releasing member for engaging a wireline fishing tool so that the releasing member can be engaged and moved axially upwards respective to the tool string to thereby communicate the cavity with the axial passageway; said releasing member having a shoulder formed thereon, said shoulder having a diameter greater than the diameter of the axial passageway in said lower member and abutingly engages the upper terminal end of said lower member to thereby limit the downward travel of said releasing member;

means, including said cavity, biasing said spherical objects axially inwardly toward said passageway so that a wireline fishing tool can be run downhole through the tool string and said releasing member engaged and moved axially to allow said cavity to communicate with said passageway, thereby causing said spherical objects to be forced from said cavity, and allowing said upper and lower members to slide apart from one another.

2. A wireline actuated releasable fluid coupling comprising an upper member, a lower member; means by which said upper and lower members are releasably affixed to one another; said means including a load transferring member for transferring a load from one of said upper and lower members to the other of said members, and a wireline actuated releasing member for removing said load transferring member from a position which enables it to transfer a load from one of said upper and lower members to the other of said upper and lower members;

said load transferring member includes a plurality of spherical objects and a cavity within which said spherical objects may be releasably contained;

said cavity comprises an annulus formed within the outermost of said upper and lower members, and a plurality of radially spaced apertures formed within a wall of the innermost of said upper and lower members;

said spherical objects being of a diameter to simultaneously bear against the structure which forms said annulus, said aperture, and said releasing member;

said cavities are radially inwardly directed and jointly formed by a part of the overlapping marginal ends of said upper and lower members;

said releasing member having a wall surface which bears against said load transferring member to hold said load transferring member within said cavity;

said upper member slidably receives said lower member therewithin, seal means between said upper and lower members, said lower member receives said releasing member therewithin, said annulus being formed within a wall of said upper member, said radially spaced apertures being formed within said lower member, a skirt formed on said releasing member to form a large and a small diameter marginal length to form a shoulder therebetween; said annulus, aperture, and skirt jointly form said cavity when said upper and lower members are aligned with one another and with the releasing member;

said skirt being received within said lower member with said shoulder abutingly engaging the upper terminal end of said lower member to thereby provide a stop which limits the downward travel of said releasing member;

abutment means formed on said releasing member for engaging a wireline fishing tool so that the releasing member can be engaged and moved axially upward respective to the tool string to thereby communicate the cavities with the axial passageway;

means by which said upper and lower members can be affixed within a tool string so that one part of the tool string can be released from another part thereof by moving said releasing member, which removes said load transferring member, thereby releasing the upper and lower members from one another.

* * * * *